US007827979B2

(12) United States Patent
Rager

(10) Patent No.: US 7,827,979 B2
(45) Date of Patent: Nov. 9, 2010

(54) ARROW REST

(75) Inventor: Christopher Rager, Bozeman, MT (US)

(73) Assignee: SOP Services, Inc., Las Vegas, NV (US)

( * ) Notice: Subject to any disclaimer, the term of this patent is extended or adjusted under 35 U.S.C. 154(b) by 475 days.

(21) Appl. No.: 11/934,326

(22) Filed: Nov. 2, 2007

(65) Prior Publication Data

US 2008/0105244 A1 May 8, 2008

Related U.S. Application Data

(60) Provisional application No. 60/856,517, filed on Nov. 3, 2006.

(51) Int. Cl.
*F41B 5/22* (2006.01)

(52) U.S. Cl. ..... 124/44.5

(58) Field of Classification Search ..... 124/23.1, 124/24.1, 44.5, 86

See application file for complete search history.

(56) References Cited

U.S. PATENT DOCUMENTS

| | | | |
|---|---|---|---|
| 3,524,441 | A | 8/1970 | Jeffery et al. |
| 4,135,486 | A | 1/1979 | Enomoto |
| 4,282,850 | A | 8/1981 | Warnicke |
| 4,351,311 | A | 9/1982 | Phares |
| 4,372,282 | A | 2/1983 | Sanders |
| 4,759,337 | A | 7/1988 | Suski |
| 4,858,589 | A | 8/1989 | Chang |
| 4,917,072 | A | 4/1990 | Chang |
| 4,936,283 | A | 6/1990 | Izuta |
| 5,042,450 | A | 8/1991 | Jacobson |
| 5,090,396 | A | 2/1992 | Bickel et al. |
| 5,253,633 | A | 10/1993 | Sisko |
| 5,273,022 | A | 12/1993 | Leven |
| 5,339,793 | A | 8/1994 | Findley |
| 5,456,242 | A | 10/1995 | Ruholl |
| 5,460,153 | A | 10/1995 | Huntt |
| 5,462,041 | A | 10/1995 | Solecki |
| 5,584,282 | A | 12/1996 | McDonald, Jr. |
| 5,611,325 | A | 3/1997 | Kudlacek |
| 5,685,287 | A | 11/1997 | Greywall |
| 5,896,849 | A | 4/1999 | Branthwaite et al. |
| 5,960,779 | A | 10/1999 | Jessee |
| 6,431,163 | B1 | 8/2002 | Chipman |
| RE38,096 | E | 4/2003 | Branthwaite |
| 6,718,964 | B1 | 4/2004 | Graf |
| 6,725,851 | B1 | 4/2004 | Graf |
| 6,978,775 | B2 | 12/2005 | Graf |

*Primary Examiner*—John Ricci
(74) *Attorney, Agent, or Firm*—Woodard, Emhardt, Moriarty, McNett & Henry LLP

(57) ABSTRACT

Certain embodiments of the present invention provide an arrow rest usable with an archery bow to support an arrow shaft in a ready-to-draw position during the draw and until the release of the arrow by an archer. The arrow rest preferably aligns an elongate axis of the arrow shaft in a desired path which the arrow follows during release from the bow and at least initially towards the target. In certain embodiments, the arrow rest includes a support frame mounted to an archery bow riser. At least one resilient, inwardly extending support piece made from a sheet-based material extends across the frame to radially support portions of the arrow shaft. In use, arrow rests according to preferred embodiments of the present invention preferably support the arrow in place and impede the arrow from laterally escaping from the arrow rest.

19 Claims, 8 Drawing Sheets

ARROW REST

This application claims the benefit of U.S. provisional application Ser. No. 60/856,517 filed on Nov. 3, 2006 and incorporated herein by reference.

FIELD OF THE INVENTION

Aspects of the present invention deal with archery bows, and in particular deal with arrow rests usable with archery bows.

BACKGROUND OF THE INVENTION

Arrow rests can be used with archery bows, including compound or recurve bows, to support and preferably stabilize an arrow shaft in position to allow the shaft to be drawn and released from an archery bow, preferably without substantial deviation from the desired flight path. Preferably, an arrow rest supports an arrow with the longitudinal axis of the arrow aligned with the eventual flight path during at least the period when the arrow is drawn until release.

Various types of arrow rests are known, including fixed arrow rests, drop away arrow rests and rests with radially inwardly extending brushes. Examples of brush arrow rests are illustrated in U.S. Pat. Nos. 5,896,849; 6,994,080 and 6,978,755.

SUMMARY OF THE INVENTION

Certain embodiments of the present invention provide an arrow rest usable with an archery bow to support an arrow shaft in a ready-to-draw position during the draw and until the release of the arrow by an archer. The arrow rest preferably aligns an elongate axis of the arrow shaft in a desired path which the arrow follows during release from the bow and at least initially towards the target. In certain embodiments, the arrow rest includes a support frame mounted to an archery bow riser. At least one resilient, inwardly extending support piece made from a sheet-based material extends across the frame to radially support portions of the arrow shaft. In use, arrow rests according to preferred embodiments of the present invention preferably support the arrow in place and impede the arrow from laterally escaping from the arrow rest.

One preferred embodiment provides an arrow rest to support an arrow shaft with fletchings for use with an archery bow. The rest includes a frame which is mountable to an archery bow riser. The frame defines an interior area for an arrow shaft to extend through in a ready-to-draw position. A support piece is mounted to the frame and extends across the interior area. The support piece is made from a piece of a resilient, flexible sheet of material. The rest further includes a plurality of flap pieces which are defined in the support piece and which define a central opening in the support piece. The central opening is sized to fit around the circumference of the arrow shaft, and the flap pieces support the arrow shaft in the ready-to-draw position. A plurality of radial extension slots are defined in the support piece. The extension slots are aligned with fletchings on the arrow shaft.

A further preferred embodiment provides an arrow rest to support an arrow shaft with fletchings for use with an archery bow. The rest encompasses a frame on an archery bow where the frame defines an interior area for an arrow shaft to extend through in a ready-to-draw position, and a support piece which is mounted to the frame and extends across the interior area. The support piece is made from one piece of a resilient, flexible sheet of material. An arrow passage is cut into the support piece through which the arrow shaft and fletchings may pass when the arrow is drawn and released. The arrow passage defines a plurality of pie-piece shaped pieces with a central opening in the support piece, and the central opening is sized to fit around the circumference of the arrow shaft. The pie-piece shaped pieces support the arrow shaft in the ready-to-draw position.

A still further preferred embodiment provides an arrow rest to support an arrow shaft with fletchings for use with an archery bow. The rest has a frame which defines an interior area for an arrow shaft to extend through in a ready-to-draw position and a support piece mounted to the frame which extends across the interior area. The support piece is made from a piece of a flexible sheet of material. Additionally, the support piece forms a plurality of flap pieces encircling a central opening sized to receive the arrow shaft, and the flap pieces support the arrow shaft in the ready-to-draw position while minimizing lateral movement of the arrow shaft. A plurality of radial extension slots are defined in the support piece from the central opening to between the flap pieces and the extension slots are aligned with fletchings on the arrow shaft.

Objects and advantages of embodiments of the present invention are further apparent from the drawings, description and claims.

DESCRIPTION OF THE PREFERRED EMBODIMENTS

Figure 1:
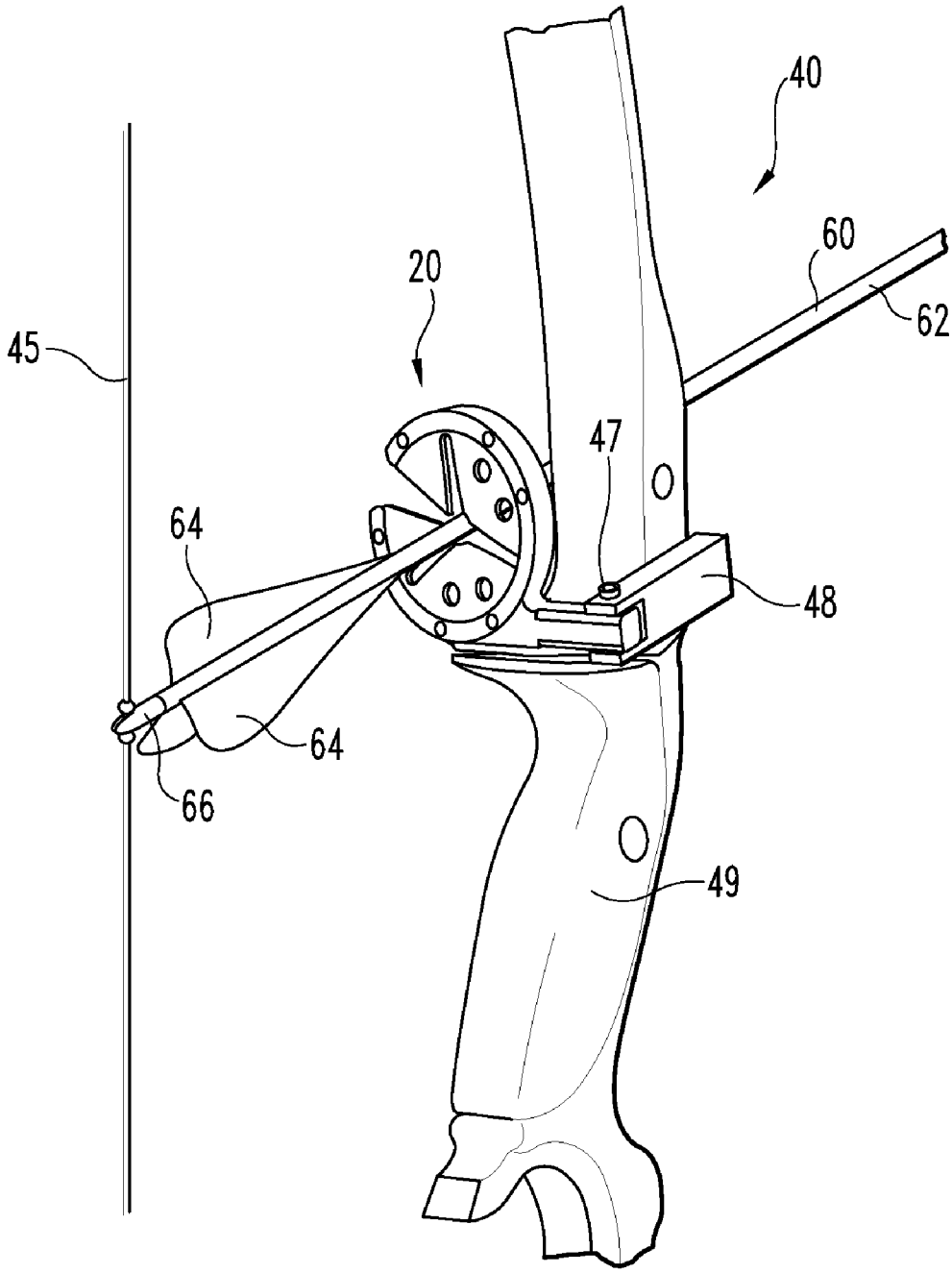
FIG. 1 is a perspective view of an embodiment of the present invention shown in the context of a partial view of an archery bow.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain embodiments of the present invention provide an arrow rest usable with an archery bow to support an arrow shaft in a ready-to-draw position, during the draw and at least until the release of the arrow by an archer. The arrow rest preferably aligns an elongate axis of the arrow shaft in a desired path which the arrow follows during release from the bow and at least initially towards the target. In certain embodiments, the arrow rest includes a support frame mounted to an archery bow riser. At least one resilient, inwardly extending support piece made from a sheet-based material extends across the frame to radially support portions of the arrow shaft. In use, arrow rests according to preferred embodiments of the present invention preferably support the arrow in place and impede the arrow from laterally escaping from the arrow rest.

Illustrated in FIG. 1 is an arrow rest 20, according to one preferred embodiment of the present invention. Rest 20 is mounted to an archery bow 40. In the version shown, archery rest 20 is mounted to a clamp 48 with a set-screw 47 which is in turn mounted to riser 49. An arrow 60 is illustrated in an undrawn or ready-to-draw position and extends between rearward bowstring 45 and rest 20 with the shaft of the arrow extending through archery rest 20 and typically toward a desired target. Arrow 60 preferably includes a shaft 62, fletchings 64 adjacent the rear of the shaft and a nock 66 at the rear of the shaft which engages bowstring 45. Commonly, an arrow includes three fletchings 64; however, two fletchings, four fletchings or more or less fletchings may be used if desired.

Figure 2:
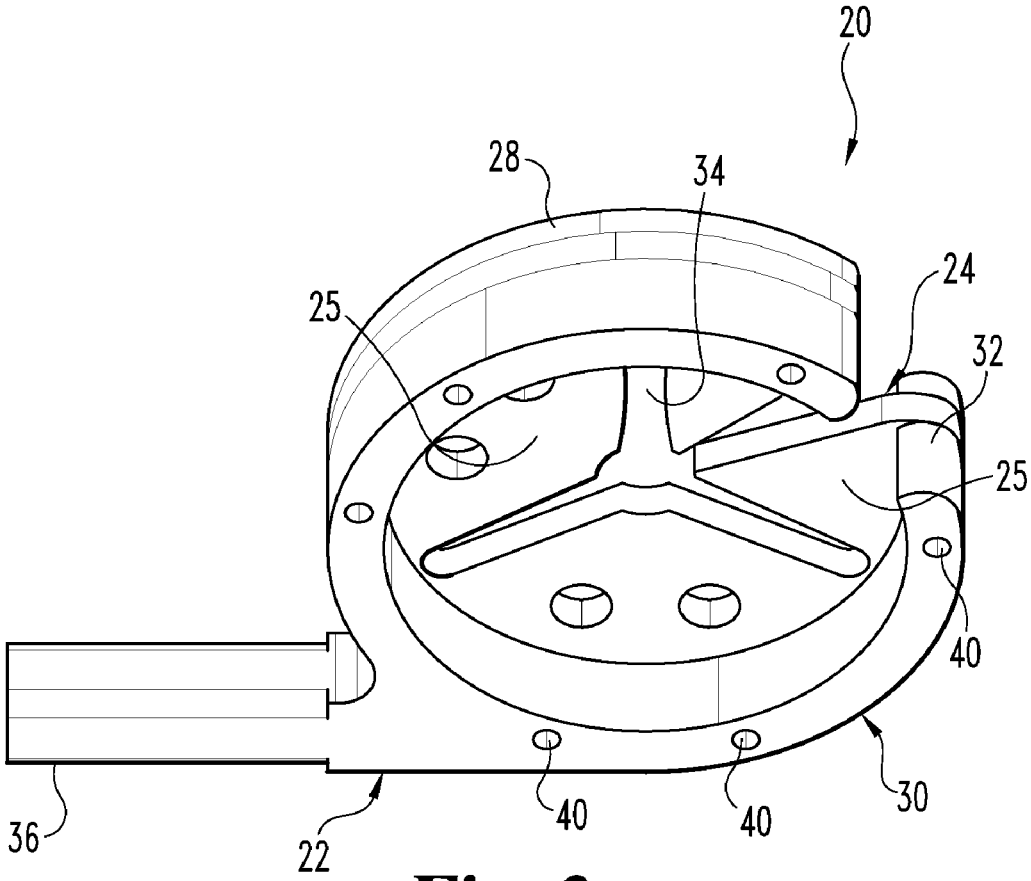
FIG. 2 is a perspective view of an embodiment of the present invention as it would be seen from the front or target side of the bow.
Figure 3:
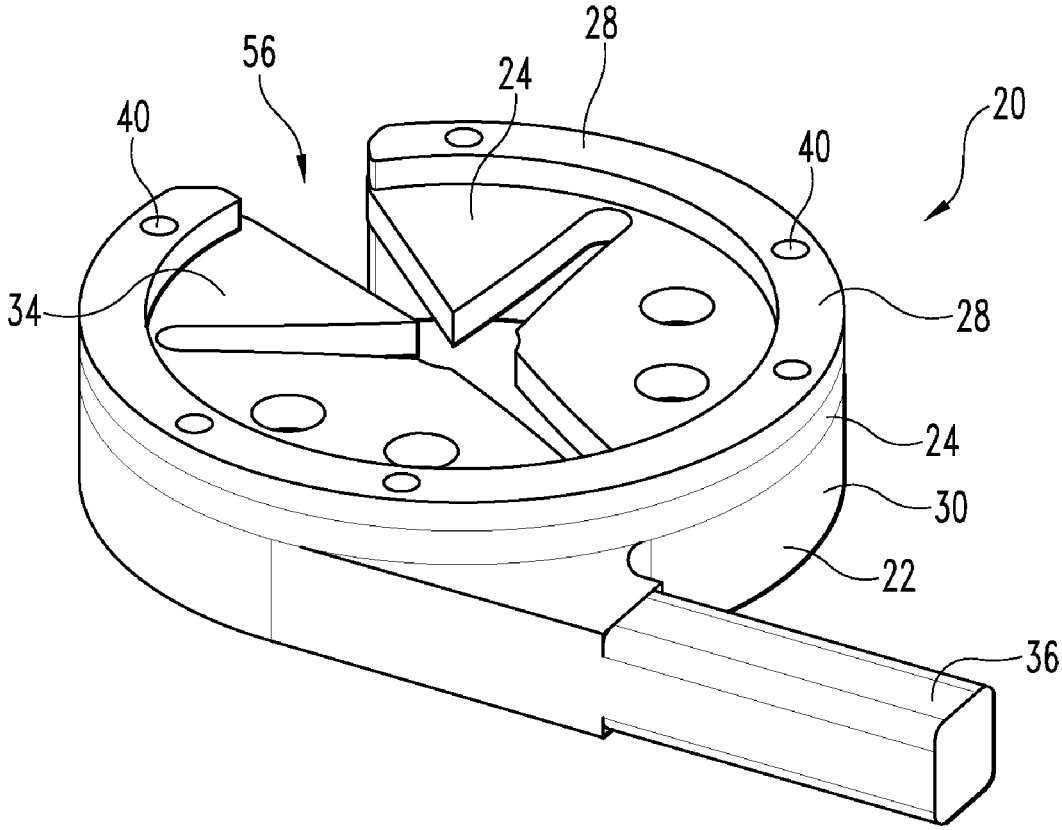
FIG. 3 is a perspective view of the embodiment of FIG. 2 viewed from the rear or archer side of the bow.
Figure 4:
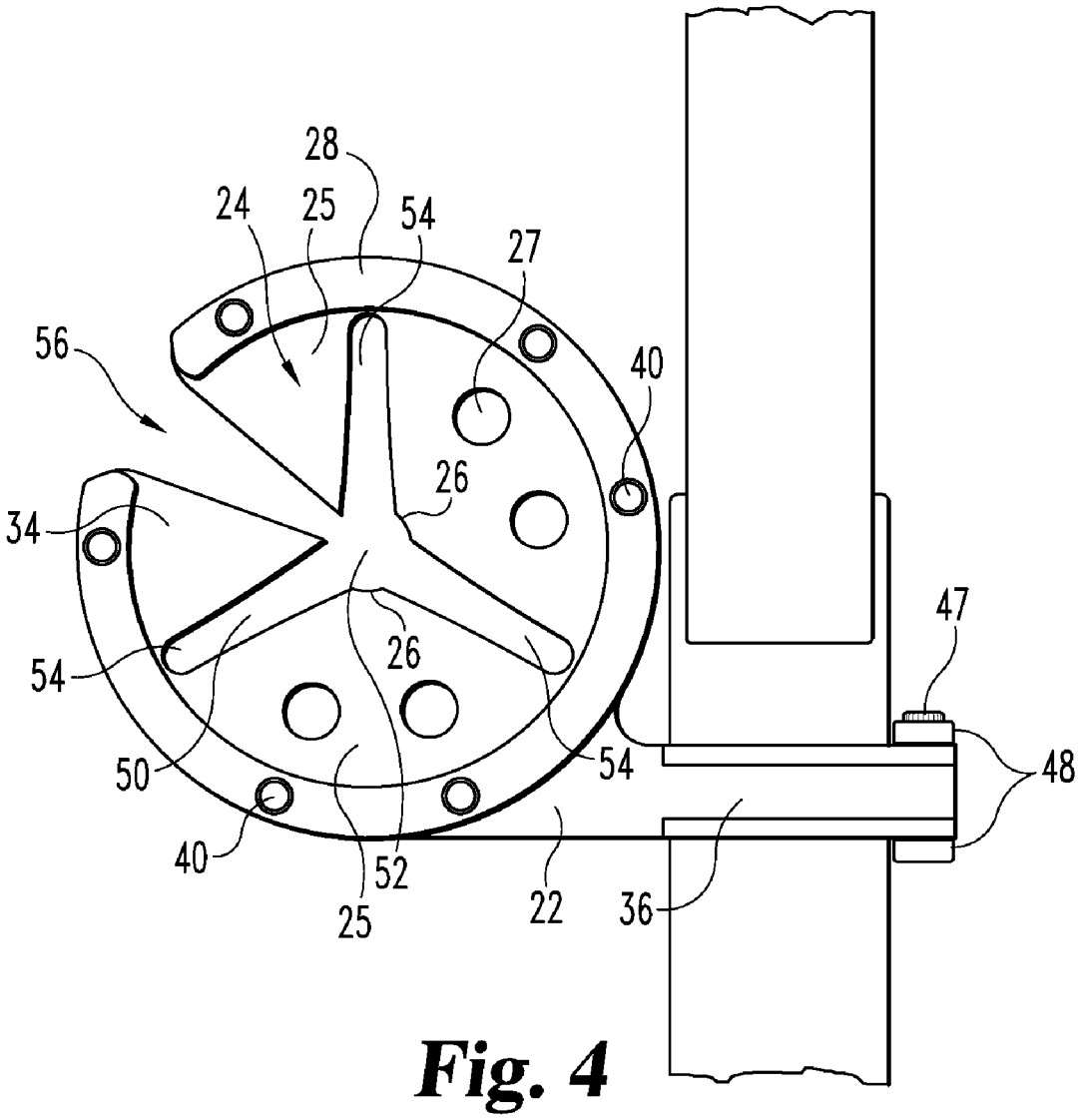
FIG. 4 is a view of the embodiment of FIGS. 2 and 3 as seen from an archer's perspective and attached to a bow.

Illustrated from a front perspective view in FIG. 2, a rear perspective view in FIG. 3 and a rear view as seen from an archer's perspective in FIG. 4 is arrow rest 20. Arrow rest 20 includes a frame 22 defining an interior area 34 within the frame for the arrow shaft to extend through in a ready-to-draw position. In certain preferred embodiments, the interior area is circular and defined by the periphery of a circular frame or ring 30. Arranged within frame 22 is a support piece 24 extending across the interior area. Support piece 24 preferably fills the frame and defines an arrow passage 50 through which the arrow shaft and fletchings may pass when the arrow is drawn and released. In the illustration shown, arrow passage 50 includes a central opening 52 for the shaft 60 of the arrow and radial extension slots 54 arranged to be aligned with fletchings 64 of the arrow when the arrow is nocked. The interaction of bowstring 45 with nock 66 preferably defines a preferred orientation of the arrow and fletchings relative to slots 54

Support piece 24 is preferably made from one or more pieces of a resilient, flexible sheet-like material extending between frame 22 and the arrow shaft. Examples of resilient or elastomeric sheet materials include rubber, foam or urethane type materials. Less preferred examples would be cardboard, leather, a sheet of plastic or a woven material. Support member 24 preferably has sufficient flexibility to not impede introduction of the arrow to the arrow rest, yet supports the weight of the arrow during the draw and further does not significantly interfere with the arrow when released from the bow.

In the embodiment illustrated, resilient support piece 24 is arranged around the circumference of arrow passage 50 and extends radially inward towards the arrow shaft. Support member 24 is shown arranged in substantially triangular or pie-piece shaped flap pieces 25 extending radially inward with truncated concave tips 26 having arc sections with a radius corresponding to the outer radius of the arrow shaft. Preferably the flap piece tips form a close tolerance fit with the circumference of the arrow shaft except at the fletching aligned slots. In certain embodiments, support piece 24 includes holes 27 extending through the support piece to reduce weight, to allow greater flexibility of the resilient material and/or to assist the archer to view the arrow shaft and/or target.

In certain embodiments, the materials and thicknesses can be selected to vary the support strength. For example a different material or a piece with a thicker piece or area with a stiffer or higher durometer can be used under the lower section of the shaft to support the arrow in the draw position, yet with more flexible or lower durometer sections at other orientations to minimize interference with the fletchings and arrow release.

In an optional feature illustrated in FIGS. 2 through 4 among others, arrow rest 20 defines an access slot or gap 56 defined through the frame 22 and support piece 24 and arranged at approximately the ten o'clock position from the archer's perspective. Alternately the gap can be at other orientations such as twelve o'clock, or symmetrically at a two o'clock position on a left handed bow. Gap 56 allows the arrow shaft to be laterally introduced into the central opening 52 of the arrow rest at a midpoint along the length of the shaft rather than the shaft being threaded through point first.

Figure 5A:
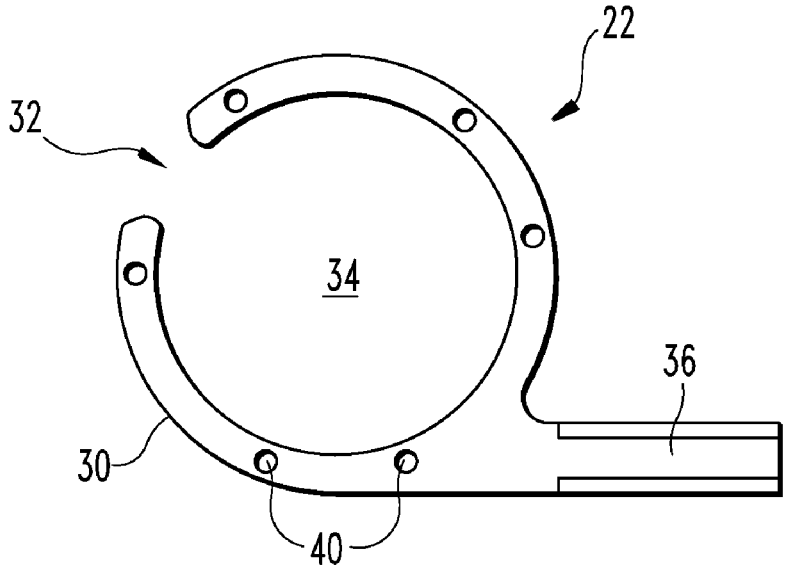
FIGS. 5A and 5B are illustrations of a frame member of the embodiment of FIG. 2.
Figure 5B:
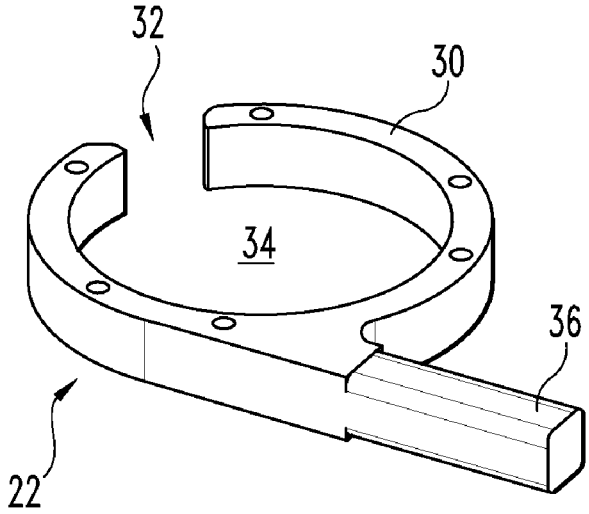

In certain embodiments, arrow rest 20 can be formed in a "sandwich" style assembly with the support piece secured between the frame and a retaining piece. Detailed views of example frame 22 are illustrated in FIGS. 5A and 5B. In the embodiment shown, frame 22 includes a generally circular ring portion 30 defining an interior area 34. Gap 32 is defined in ring 30 to facilitate introduction of the arrow shaft laterally into the interior area 34. A stem or extension portion 36 extends from ring 30 and is preferably adapted to be secured to the archery bow, for example using clamp 48 on riser 49.

Figure 6A:
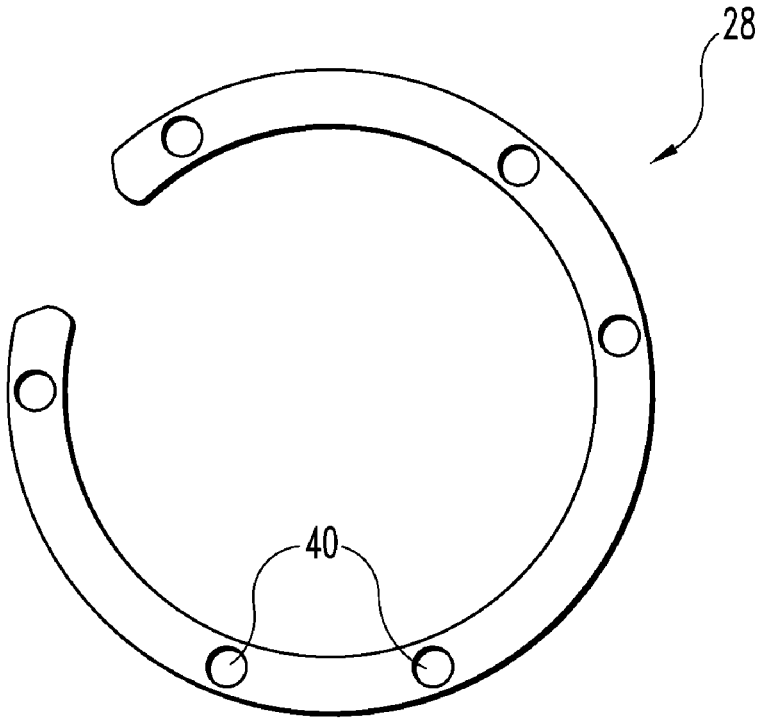
FIGS. 6A and 6B are views of a ring member as used in the embodiment of FIG. 2.
Figure 6B:
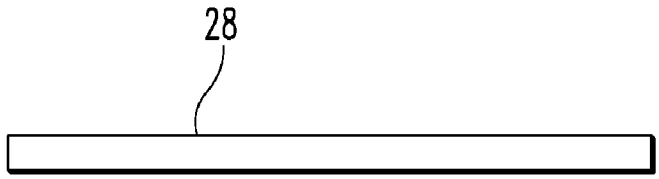

FIGS. 6A and 6B illustrate views of a retaining piece such as retaining ring 28 which can be aligned with frame ring 30, with support piece 24 secured between the retaining ring and the frame ring. Preferably retaining ring 28 is matched in size and shape to frame ring portion 30, and defines an interior area matched to the interior area of the frame. Openings 40 are shown in frame ring 30, support piece 24 and retaining ring 28 for fasteners, such as screws, to secure the pieces together.

Figure 7A:
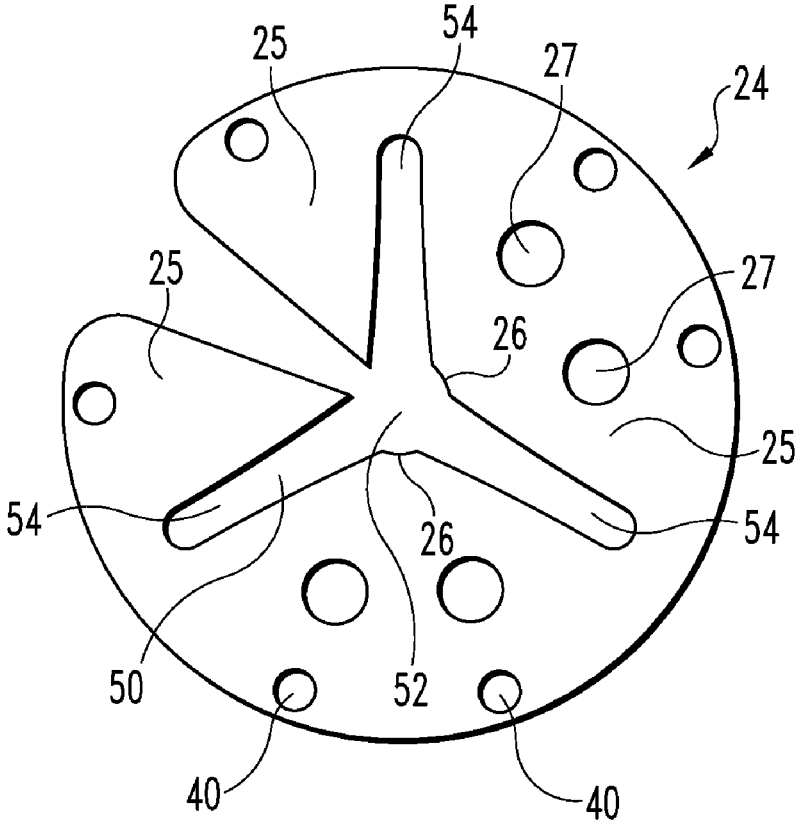
FIGS. 7A and 7B are views of a resilient support member usable in the embodiment of FIG. 2.
Figure 7B:
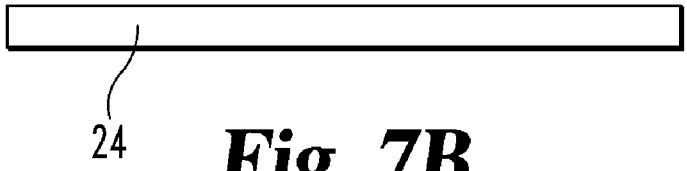

Illustrated in FIGS. 7A and 7B are views of support piece 24. As shown, support piece 24 is circular and defines an arrow passage 50 through the piece. Arrow passage 50 includes a central opening 52 along a central axis and radially extending slots 54 corresponding in number and intended to be aligned with fletchings of the arrow when nocked. Extension slots 54 preferably have sufficient length radiating from the center to allow passage of the arrow fletchings through the arrow rest without substantially touching or impeding the passage. Pie-piece shaped flap pieces 25 extend radially inward toward and encircle the central opening 52. Flap pieces 25 preferably have truncated inward tip portions 26 to form a close fit with the arrow shaft. Preferably, the spacing of flaps 25 and central opening 52 engage the arrow shaft to support and hold it in a ready-to-draw position once in place in the arrow rest. Slots 54 are defined between flaps 25. The spacing preferably also allows sufficient tolerance to easily allow the arrow shaft to slide when the arrow is drawn and released from the bow. The fit to the shaft can be loose or snug as preferred to minimize lateral movement of the arrow shaft yet allowing a clean release.

In the illustrated embodiment, support piece 24 is made from a one piece circular sheet of material into which the central opening and slots are cut or molded. Alternately, the support piece can be made of multiple pieces mounted to the frame to extend inwardly. In a multiple piece embodiment, optionally the pieces can be made from differing materials or with differing thicknesses.

Support piece 24 preferably is made from a sheet-like material with a width or thickness suitable to allow pieces 25 to support the arrow shaft without deflecting under the weight of the shaft at rest. Alternately, the support piece can be formed from multiple layers to achieve a desired thickness through all or the portions surrounding the arrow shaft.

In the example shown, four pie-piece shaped flaps are used to extend around the arrow shaft, with two pieces spanning approximately 120 degrees (less slot widths) each and two pieces spanning approximately 120 degrees together (less slot width), with a gap defined between them to allow lateral entry of the arrow shaft. In an embodiment where each slot spans 10°, the flaps would span 110° respectively. Preferably the number of flaps corresponds to the number of fletchings to encircle the shaft with separations only defined at the slot locations, although optionally also including an access slot. In an alternate embodiment (FIG. 8), three 120 degree spanning pieces (less slot width) are used. Pieces spanning smaller angles can optionally be used, but are less preferred.

By way of example only, frame ring 30, retaining ring 28 and support piece 24 can have an outer radius of 1.0 inch and an outer diameter of 2.0 inches. Frame ring 30 and retaining ring 28 have an inner radius of 0.825 inches and a 0.4 inch opening at gap 56. As shown, stem 36 extends 2.0 inches from a vertical centerline of the frame ring to the stem end. In support piece 24, the central opening 52 has a diameter of 0.31 inches. The extension slots 54 have a width of 0.125 inches and a radial length of approximately 0.8 inches from the central axis. As shown, gap 56 encompasses an angle of 18° degrees, with a 0.3 inch outer opening which narrows to a 0.1 inch inner opening to central opening 52. In this version, the thickness of the support piece is 0.125 inches. The outer opening of the support piece is slightly smaller than the outer opening of the frame ring.

During assembly of the illustrated embodiment, support member 24 is sandwiched or secured between frame ring 30 and retaining ring 28. If the embodiment includes an arrow introduction gap, corresponding gaps are aligned between the respective pieces. The layers are then secured together to form arrow rest 20, optionally compressing the support piece. Various fasteners may be used such as screws extending through aligned openings 40 in the rings and support piece. Alternate securing methods include adhesive, bolts and nuts, rivets, welding, clamps or deformable materials. In certain embodiments, frame 22 and ring 28 can be made from rigid metal materials such as steel, stainless steel, aluminum or titanium or alternately can be made from durable plastic materials, made for example by fiber-reinforced composites or injection molding. A specific example material is 6061 T6 aluminum. Frame 22 and ring 28 can optionally be decorated as desired, for example with an anodized finish or camouflage covering. Support piece 24 can also be decorated with color, patterns or camouflage if desired.

Figure 8:
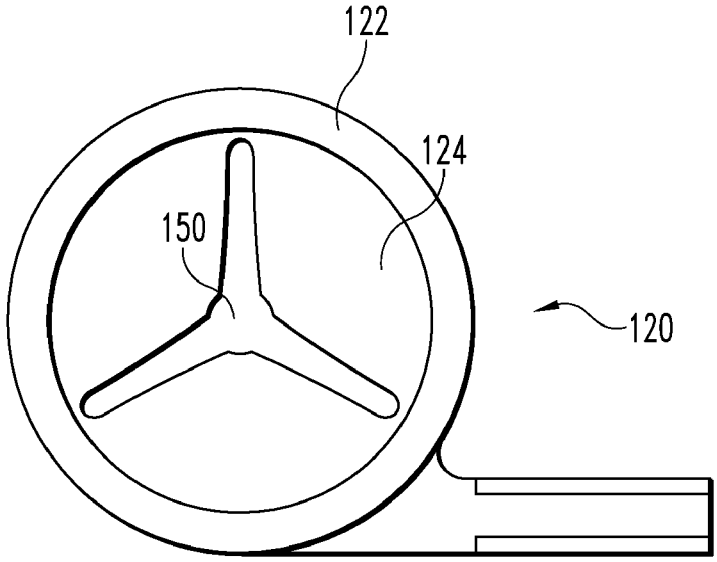
FIG. 8 is a view of an alternate embodiment of the present invention.

An alternate embodiment of an arrow rest is show in FIG. 8. Arrow rest 120 in FIG. 8 includes a frame portion 122 with a support piece 124 with three flap pieces spanning approximately 120 degrees each and defining an arrow passage opening 150. Arrow rest 120 does not include the side opening slot for introduction of the arrow shaft. In use, arrow rest 120 has the arrow point threaded through opening 150 to place the arrow on the arrow rest before use. The flaps of support member 124 support and hold the arrow shaft and prevent the shaft from laterally escaping from the arrow rest.

Further preferably, the resilient elastomeric material of the support piece allows passage of the arrow shaft and fletchings with a minimum of friction when the arrow is released, thus limiting contact, interference with the flight path or speed, and potential damage to the shaft or fletchings. The support piece material also preferably allows the arrow shaft and fletchings to slide quietly through the arrow rest to minimize noise upon release.

Preferably the arrow rest allows for adjustment of the frame and replacement of the support piece when worn or damaged. In the embodiments illustrated, the arrow rests include an extension member mountable to an archery bow riser, for example securable to a clamp 48 and tightened with set screw 47.

Figure 9:
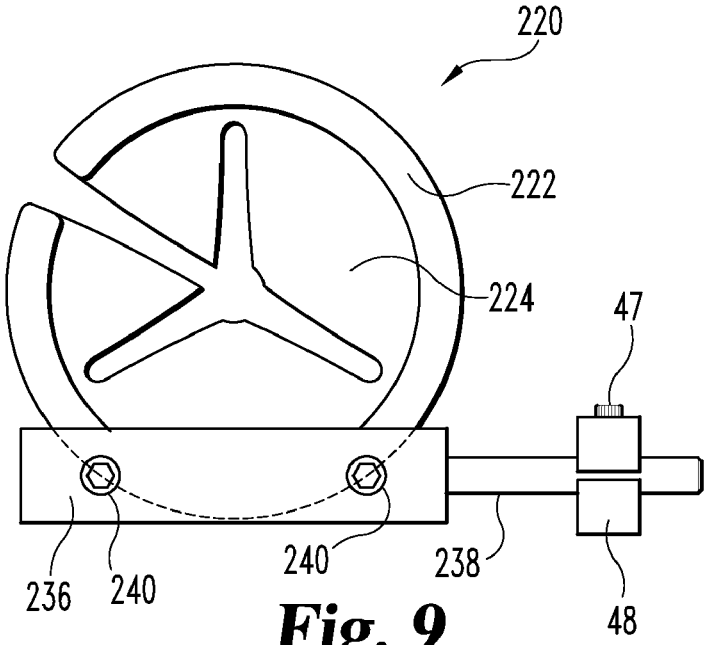
FIG. 9 is a view of an alternate embodiment of the present invention.

An alternate embodiment shown in FIG. 9 includes a rest 220 and, a frame 222 surrounding a support piece 224 which can be secured to the riser. In the embodiment shown, a bracket 236 with a gap or nested area receives and holds an edge of a circular disc forming frame 222. The bracket 236 can be loosened or compressed using fasteners 240 to grip the frame. An arm 238 extends from bracket 236 and can be held in clamp 48 with set screw 47. Alternate attachment methods include fasteners extending between the arrow rest and bow such as a direct screw or a clamp. In a further option, the arrow rest frame can be integrally made into the bow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An arrow rest to support an arrow shaft with fletchings for use with an archery bow, comprising:

a. a frame mountable to an archery bow riser wherein said frame defines an interior area for an arrow shaft to extend through in a ready-to-draw position;

b. a support piece mounted to said frame and extending across said interior area, wherein said support piece is made from a piece of a resilient, flexible sheet of material, wherein said support piece incorporates a higher durometer portion under the shaft to support the arrow in the draw position and with lower durometer portion in other portions of said support piece;

c. a plurality of flaps pieces defined in said support piece and defining a central opening in said support piece, wherein said central opening is sized to fit around the circumference of the arrow shaft, wherein said flap pieces are approximately triangular shaped, and wherein said flap pieces support the arrow shaft in said ready-to-draw position; and, d. a plurality of radial extension slots defined in said support piece wherein said extension slots are aligned with fletchings on the arrow shaft.

2. The arrow rest of claim 1, wherein said flap pieces have truncated tip portions.

3. The arrow rest of claim 2, wherein said truncated tip portions form concave tips with arcs having a radius corresponding to the outer radius of the arrow shaft.

4. The arrow rest of claim 1, wherein said frame and said support piece define a gap allowing the arrow shaft to be introduced into said central opening laterally at a midpoint along the length of the arrow shaft.

5. The arrow rest of claim 4, wherein said gap is arranged at approximately the ten o'clock position on the frame as viewed from the archer's perspective.

6. The arrow rest of claim 4, wherein said support piece is made from one piece of material.

7. The arrow rest of claim 4, wherein said support piece is made from multiple substantially triangular shaped pieces of material extending inward towards the arrow shaft.

8. The arrow rest of claim 4, wherein said extension slots have sufficient length radiating from the central opening to allow passage of the arrow fletchings through the arrow rest without touching the support piece.

9. The arrow rest of claim 8, comprising a retaining piece matched to said frame and defining an interior area matched to the interior area of said frame and, wherein said support piece is secured between said retaining piece and said frame.

10. The arrow rest of claim 4, wherein said flap pieces comprise four sections with two pieces spanning approximately 120 degrees each and the remaining two pieces spanning approximately 120 degrees in total with a gap defined between them.

11. The arrow rest of claim 1, wherein said flap pieces comprise three sections spanning approximately 120 degrees each.

12. The arrow rest of claim 1, wherein said frame comprises an extension member securable to the archery bow riser.

13. The arrow rest of claim 1, wherein at least one of said plurality of flap pieces defines a hole extending through said flap piece to reduce the weight of said flap piece.

14. An arrow rest to support an arrow shaft with fletchings for use with an archery bow, comprising:

a. a frame mountable to an archery bow, said frame including an extension portion laterally extending toward an archery bow riser to be secured with a clamp to said riser, and wherein said frame defines an interior area for an arrow shaft to extend through in a ready-to-draw position;

b. a support piece mounted to said frame and extending across said interior area, wherein said support piece is made from one piece of a resilient, flexible sheet of material;

c. an arrow passage cut into said support piece through which the arrow shaft and fletchings may pass when the arrow is drawn and released, said arrow passage defining a plurality of pie-piece shaped pieces around a central opening in said support piece, wherein said central opening is sized to fit around the circumference of the arrow shaft, and wherein said pie-piece shaped pieces support the arrow shaft in said ready-to-draw position; and d. holes extending through said support piece to reduce weight, and to allow greater flexibility of said resilient material.

15. The arrow rest of claim 14, wherein, said arrow passage defines a plurality of radial extension slots defined in said support piece between said pie-piece shaped pieces.

16. The arrow rest of claim 14, wherein said pie-piece shaped pieces have truncated tip portions with concave tips defining arcs having a radius corresponding to the outer radius of the arrow shaft.

17. The arrow rest of claim 14, wherein said frame and said support piece define a gap allowing the arrow shaft to be introduced into said central opening laterally at a midpoint along the length of the arrow shaft.

18. An arrow rest to support an arrow shaft with fletchings for use with an archery bow, comprising:

a. a frame defining an interior area for an arrow shaft to extend through in a ready-to-draw position;

b. a support piece mounted to said frame and extending across said interior area, wherein said support piece is made from a piece of a flexible sheet of material;

c. wherein said support piece forms a plurality of flap pieces encircling a central opening sized to receive the arrow shaft, and wherein said flap pieces support the arrow shaft in said ready-to-draw position while minimizing lateral movement of the arrow shaft;

d. a plurality of radial extension slots defined in said support piece from said central opening to between said flap pieces wherein said extension slots are aligned with fletchings on the arrow shaft; and, e. a retaining piece matched to said frame and defining an interior area matched to the interior area of said frame and, wherein said support piece is secured between said retaining piece and said frame.

19. The arrow rest of claim 18, wherein said flap pieces are substantially triangular with truncated tip portions with concave tips defining arcs having a radius corresponding to the outer radius of the arrow shaft.

* * * * *